United States Patent [19]

Bailey

[11] 3,934,766

[45] Jan. 27, 1976

[54] GARMENT FINISHER

[75] Inventor: Stanley M. Bailey, Hamburg, Pa.

[73] Assignee: Garment Finishing Equipment Corporation, Cambridge, Mass.

[22] Filed: Feb. 3, 1975

[21] Appl. No.: 546,213

Related U.S. Application Data

[63] Continuation-in-part of Ser. No. 508,885, Sept. 24, 1974, Pat. No. 3,883,051.

[52] U.S. Cl. ..... 223/73; 223/51

[51] Int. Cl.[2] ..... D06C 15/00

[58] Field of Search ..... 223/72–74, 223/57, 70, 61, 63, 65, 51; 68/5 R, 5 A

[56] References Cited

UNITED STATES PATENTS

| | | | |
|---|---|---|---|
| 1,468,721 | 9/1923 | Macy | 223/73 |
| 1,501,307 | 7/1924 | Boyuls | 223/73 |
| 1,986,386 | 1/1935 | Behringer | 223/73 X |
| 3,439,845 | 4/1969 | Lester | 223/73 |
| 3,713,567 | 1/1973 | Paris | 223/73 |
| 3,866,808 | 2/1975 | Bailey | 223/73 |

FOREIGN PATENTS OR APPLICATIONS

| | | | |
|---|---|---|---|
| 45-41080 | 12/1970 | Japan | 223/73 |

*Primary Examiner*—G. V. Larkin
*Attorney, Agent, or Firm*—Parmelee, Miller, Welsh & Kratz

[57] ABSTRACT

Apparatus for accurately and fully finishing or pressing garments is shown that employs a motor-driven air blower whose motor has automatic braking means for substantially instantly stopping it when de-energized, and that has an electrical heater for air being supplied by the blower to the atmosphere of a permeable bag along which a garment is to be positioned. Side-mounted pairs of upper and lower creasing blades are operated to expand and contract and are provided with electrical heating means along their lengths for directly applying creasing heat. Steam is supplied to a piping system which extends along and within the permeable bag for both applying heat indirectly and applying periodic bursts of steam directly to the inside of the garment being finished. Steam from the indirect heat application is then passed through a heat exchanger for applying its residual heat to preliminarily heat air being supplied by the blower.

10 Claims, 11 Drawing Figures

GARMENT FINISHER

CROSS-REFERENCE TO RELATED APPLICATION

This application is a continuation-in-part of my application Ser. No. 508,885 filed Sept. 24, 1974, entitled "Garment Finishing Appartus", now U.S. Pat. No. 3,883,051.

BACKGROUND OF THE INVENTION

1. Field of the Invention

This invention relates to improved apparatus for finishing or pressing garments or articles of clothing, such as shorts, trousers, slacks, dresses, shirts, sweaters, skirts and jackets and particularly, to apparatus whose operation, temperature of air application and manner of heat application are accurately controlled. A phase of the invention deals with the accurate, direct application of heat to creasing blades of the apparatus.

2. Description of the Prior Art

The Paris U.S. Pat. No. 3,713,567 and my U.S. application Ser. No. 469,829 of May 14, 1974 entitled "Pants Presser", now U.S. Pat. No. 3,866,808 and Ser. No. 508,885 of Sept. 24, 1974, entitled "Garment Finishing Apparatus" are illustrative of the general development of the art of finishing or pressing garments such as pants, employing creasing blades, steam and air. My copending application Ser. No. 508,885 deals particularly with a piping system, utilizing a closed array for indirectly supplying steam heat and a spray array for periodically supplying steam to the article being processed.

The apparatus of the present invention deals with the problem of the need for increased and accurately controlled heat, for localized blade heating, and for better control of the temperature of the supply of air to a permeable garment bag, such as of nylon.

SUMMARY OF THE INVENTION

It has thus been an object of the invention to devise a garment finishing apparatus that will meet the need for a more accurate control of and a more localized application of processing heat.

Another object has been to enable the attainment of a relatively uniform and a higher temperature for air being supplied to a garment being processed.

A further object has been to provide means for directly and individually heating creasing blades of a garment processing machine.

A still further object has been to increase the overall efficiency and adaptability of garment finishing equipment.

These and other objects will appear to those skilled in the art from the illustrated embodiment and the claims.

DESCRIPTION OF THE PREFERRED EMBODIMENT

Figures 1, 1A, 2, 3, 4, 5:
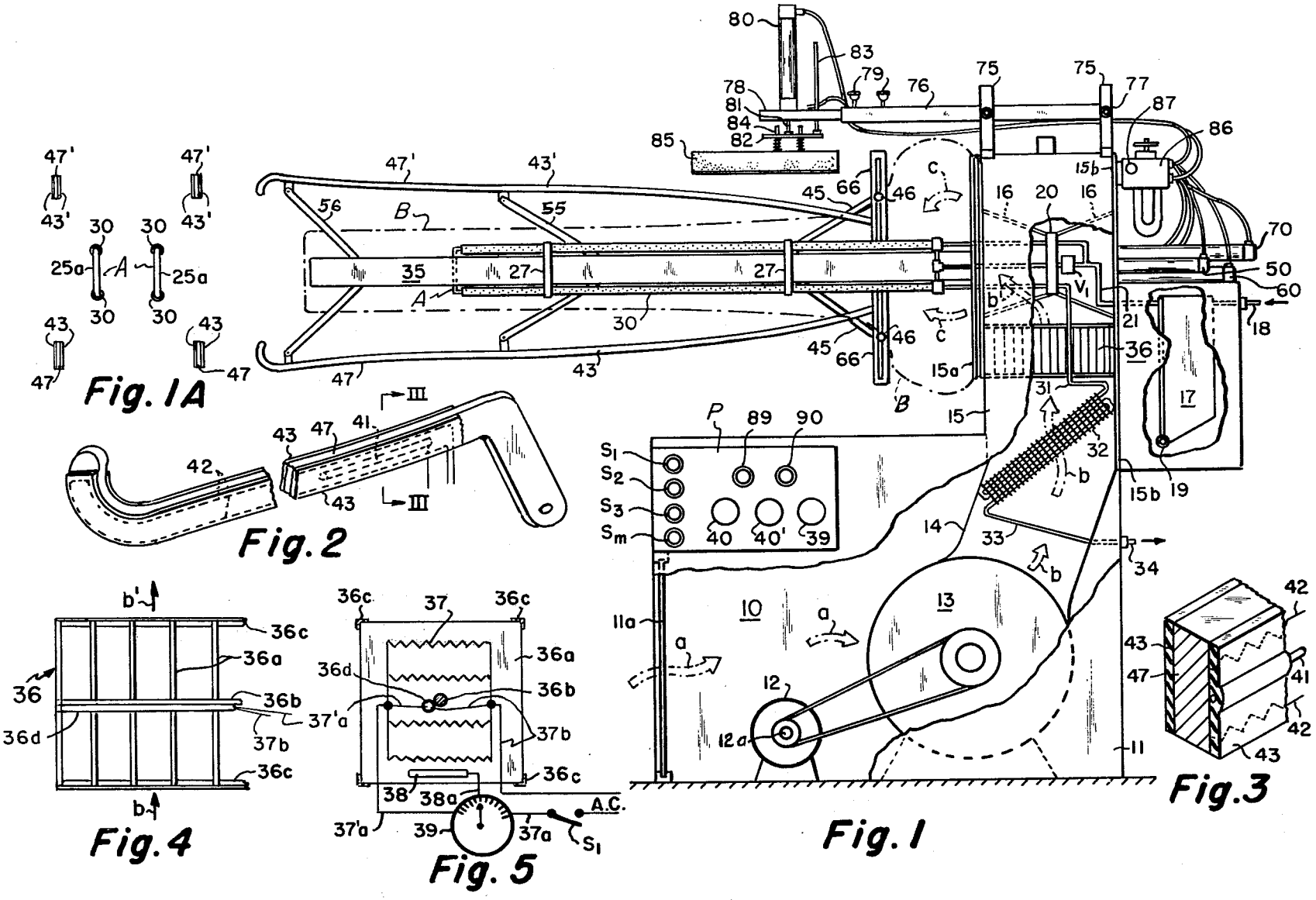
FIG. 1 is a side view in elevation, partially broken away, showing a finishing machine employing apparatus of the invention and showing a permeable garment bag in an operating position with dot and dash lines.
FIG. 1A is an enlarged fragmental view taken from the front end of the machine of FIG. 1 to show heating means.
FIG. 2 is a further enlarged, broken-away, side perspective showing the construction of an electrically heated creasing blade of the machine.
FIG. 3 is a further enlarged fragmental section in side perspective also illustrating the blade construction and taken along the line III—III of FIG. 2.
FIG. 4 is an enlarged fragmental side elevation of an electrical, grill-like heater shown in FIG. 1 and employed for finalizing the heating of air being supplied to a permeable garment bag.
FIG. 5 is a diagrammatic representation of an electrical control circuit for the heater of FIG. 4.

As shown in FIG. 1, a finishing or pressing machine or apparatus has a floor-mounted support base or cabinet 10, as represented by a floor-mounted, pressurizing air supply unit. The base 10 has an enclosing housing 11 of plate-like construction and is open at one end and provided with a screen 11*a* for admitting air therein, see arrows *a*. Air thus introduced into the housing 11 is moved under positive or forced pressure by blower 13 into and along upwardly extending flow duct 14 and housing of a support head 15. The blower 13 is shown driven by a belt through the agency of an electric motor M or 12 and its drive shaft 12*a* on one end of which a drive pulley is mounted and on the other end of which a braking mechanism, see FIGS. 8 and 9, is operatively positioned.

Figure 8:
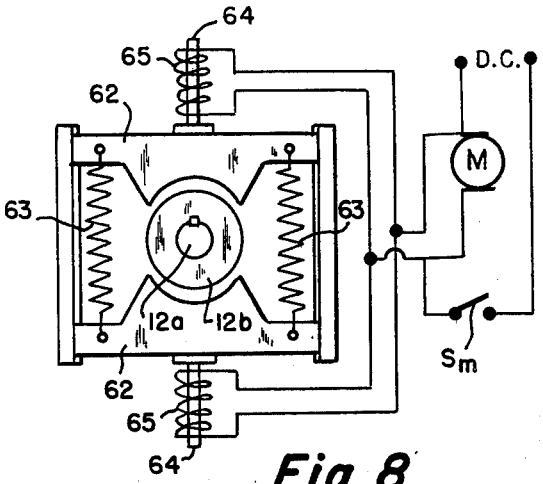
FIG. 8 is a diagrammatic showing of a motor energizing the instant braking arrangement and elecrical control circuit therefor.
Figure 9:
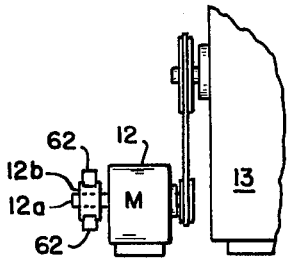
FIG. 9 is a side fragmental elevation further illustrating air-blower operating motor and brake means of FIGS. 1 and 8.

Both the motor M and a pair of brake-releasing coils 65 of solenoids 64 are de-energized by opening a switch $S_m$ which may be a timed solenoid type, but which in FIG. 8 is shown as a manual type and in FIG. 1 as a manual pushbutton type. This assures a substantially instantaneous stoppage of the motor M and a quick deflation of a permeable garment bag B at the end of a garment finishing operation. It will be noted that a brake drum 12*b* is mounted on the one end of the motor shaft 12*a*, and when the coils 65 are de-energized, is subjected to the braking action of a pair of opposed shoes 62, as mechanically urged towards each other by tension springs 63. However, when the switch $S_m$ is closed and energizing current is being introduced to actuate the motor M, this simultaneously causes an energization of the coils 65, whereby the solenoids 64 draw the brake shoes 62 to an open position illustrated in FIG. 8. This braking assembly enables permeable nylon garment bag B to quickly collapse as a result of a shutting-off positive pressure supply of air from the blower 13. After this has been accomplished upper and lower creasing blades 47 andn 47' are then moved from expanded towards collapsed positions.

Figure 6:
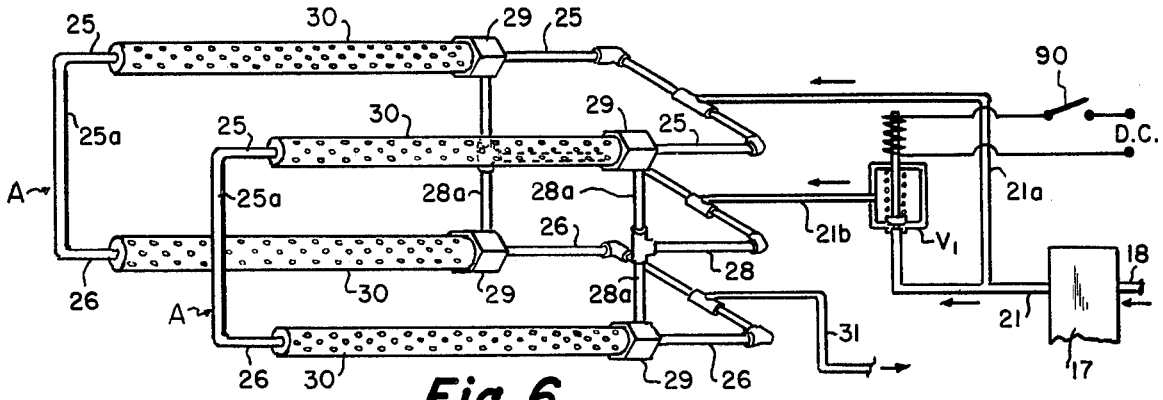
FIG. 6 is a side perspective on an enlarged scale with respect to FIG. 1, illustrating a steam utilizing piping system.

Again referring to FIG. 1, atmospheric air leaves blower 13 under positive pressure, as indicated by arrows *b*, and in its upward travel passes through a heat-exchanger 32 and between grid or plate-like heated members 36*a* of an electric heater 36. The air being introduced into garment bag B (see flow arrows *b*, *b'* and *c*) may be accurately heated to a desired temperature for the particular type of garment or material being processed. A full showing of the shape, construction and utilization of the permeable bag B has been set forth in my earlier application Ser. No. 469,829, now U.S. Pat. No. 3,866,808. In this connection, see also FIGS. 4, 5 and 6 of the Paris U.S. Pat. No. 3,713,567. Such a bag B is interposed as intermediate protective and forming agency between support members of the machine and the interior of the garment being finished, with the creasing blades 47 and 47' being used directly within the garment, outside the bag. Although a heat exchanger 32 which makes use of residual heat that is returning from the system shown in FIG. 6 is effective in heating the rising air, the unit 36 enables the provision of higher temperatures and also a better control of the exact temperature that is required for a particular garment or material. The heat exchanger 32 may provide a temperature of about 160° F. which is suitable for washable wools. However, it is desirable to employ higher temperatures for synthetic material. For example, air may be supplied at about 250° F. when the garment is of nylon material, at about 310° F. when the garment is of permanent press cotton material, and at a temperature of 350° to 375° F. for a garment of synthetic material, such as polyester.

Details of operating mechanism for expanding and contracting the creasing blades 47 and 47' has been set forth and disclosed in my application Ser. No. 469,829. In FIG. 1, each upper and lower blade 47' and 47 is provided at its innermost end with a dog-leg portion (see also FIG. 2) that with an outer end of an expander member 45 is adapted to pivotally ride on a roller 46 that is guidably mounted to move along vertically slotted portion of a guide member 66.

FIG. 5 shows a control system for heating the unit 36. The unit 36 is shown provided with upright angle-shaped frame members 36*c* and a centrally disposed tie rod 36*b* that tie a group of transversely spaced-apart, vertically extending plate-like fin or grid members 36*a* to define through spacing or passageways therebetween along which the air (indicated by arrow *b*) from the duct 14 willl flow along the duct continuation represented by the head 15. Each plate 36*a* may be provided with one or more electrical resistance heating elements 37, such as a Calrod unit. In FIG. 5, four elements are shown connected in parallel. These, in turn, will be connected in parallel with the elements or units of the other plate members through the agency of electric leads, such as 37*b* and 37'*a*. These leads may extend along a hollow non-conductor, cross-extending tube 36*d* that is positioned along the post 36*b*, see also FIG. 4.

The electrical heating elements 37 are preferably energized by alternating current, such as 220 volts, supplied to lines 37*a* and 37*b* and as controlled by a pushbutton switch $S_1$, see FIGS. 1 and 5. A temperature indicator and adjustable control unit of conventional construction 39 is shown connected in the line 37*a* to supply current to output line 37'*a* as proportioned to the desired "set" temperature on the dial of the control unit. The desired set temperature may be automatically controlled by the unit 39 in accordance with readings imparted to its through line 38*a* from a temperature probe 38 of conventional construction. The probe 38 may be suspended in a central passageway between plates 36*a* of the unit 36 to give an accurate reading of the attained temperature of the air flowing therethrough. The operator may set the unit 39 to the desired temperature by moving its control pointer or arm to such a temperature reading on its face at which time the unit, itself, will then take over and automatically maintain such a temperature.

The upper end of the air supply duct 14 terminates in the support head structure 15. It will be noted that the open end of the permeable bag B is secured in position on a front flange 15*a* of the enclosing head structure 15. It will also be noted that other operating structure is carried or supported by such head. The fabric, garment receiving bag B extends from the forward open end portion of the flange 15*a* along a pair of transversely spaced-apart parallel, side by side, longitudinally extending, support arms or members 35 of a frame or longitudinal support structure. The support members 35 are secured at their back ends to extend forwardly from a back end wall 15*b* of the head enclosure structure 15. Details of the mounting and construction of the members 35 have been fully disclosed in my application Ser. No. 469,829.

As shown particularly in FIG. 1, live steam is supplied through an inlet line or pipe 18 from a conventional generator and into a condensate separator and trap unit 17. Liquid collected in the trap of the unit 17 may be taken-off through a side-mounted outlet nipple 19. Live steam leaves the trap 17 through a main supply line 21, see also FIG. 6, and then moves directly into branch line 21*a* and indirectly through a solenoid-operated valve $V_1$ into branch line 21*b*. The valve $V_1$ is operated by direct current supplied from a suitable source and as controlled by a pushbutton switch 90. This valve is normally spring-pressed to a closed position and is open periodically to provide so-called steam bursts inside of the garment through the agency of the bag B. Such a steam burst is supplied to perforated, tubular, sleeve-like, jacket diffusion members 30 which are carried in a spaced relation along closed-off, indirect heat-supplying pipe members 25 and 26. The steam supply system represented by such piping is adapted to, as shown in FIG. 1, extend along, above and below the support members 35 and to be held in position with respect to each other and thereon by cross-tie members 27.

Figure 7:
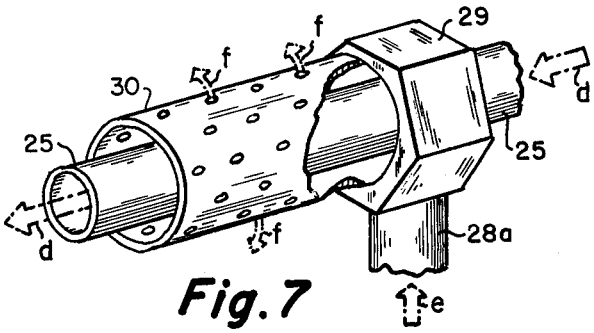
FIG. 7 is a greatly enlarged fragmental isometric view showing details of the construction of a closed-off, loop pipe member and a perforated, tubular jacket or sleeve-like distribution head of the assembly of FIG. 6 for providing distribution of heat and steam along the inside of the length of a garment being processed.

A continuous flow of heated fluid, such as steam, is supplied through line 21 and upper forked piping provided by the pair of branch pipe members 25 and is advanced therealong to move downwardly along connecting, front, cross pipe members 25*a* to a pair of spaced-apart lower branch pipe members 26, and from the latter pipe members at their back ends to a downward stream or outflow pipe 31. Residual heat contained in the fluid or steam, then as shown in FIG. 1, may be utilized by heat exchanger 32. Outflow from the exchanger 32 may be moved by pipe member 33 to an outlet fitting 34 and finally, returned for reuse in the steam generator (not shown). On the other hand, steam introduced through line 21*b* flows along branch lines 28 and vertical or cross piping 28*a* into end connectors 29. Inner ends of longitudinally forwardly extending, perforated diffusion members 30 are supplied with steam from the end connectors 29, and extend in a spaced relation substantially fully as jackets along the upper and lower pipe members 25 and 26 of the loop-like closed system, see also FIG. 7. Steam may thus be directly supplied, as in hot moisture-carrying bursts, through holes or perforations that are spaced along the members 30, see the arrows *f* of FIG. 7.

Reversible or dual-acting fluid motors 50, 60 and 70 (see FIG. 1) are connected to operate each side pair of leg creasing blades consisting of an upper blade 47' and a lower blade 47 along opposite sides of the support members 35. The operation is effected through the agency of upper and lower operating arm pairs 45, 55 and 56. Air under pressure is introduced through inlet 87, into a filter regulator and lubricator unit 86 and thence, through flexible tubing to the motors 50, 60 and 70 and also 80. Air under positive pressure may be introduced into the inlet 87 through an electrical, solenoid-operated, air-control, pushbutton switch 89 on the panel P.

Fluid motor 80 is carried on a slide arm 78 by a panel 76 that is adjustably mounted on the support head 15 by mounting brackets 75 and bolts 77. Thumbscrews 79 are carried by the panel 76 to adjustably position the arm 78 with respect thereto. A fly presser head 85 is mounted on a cross blade 82 through the agency of a pair of spaced-apart expansion spring and bolt mounts 84. Piston rod 81 of dual-acting air motor 80 is secured to the plate 82, and a guide rod 83 extends through a hole in the arm 78 and is also secured to the plate 82.

The apparatus provides an improved finishing of garments of various types with a close control as to temperataure, so as to provide better conditioning without danger of heat-scorching or localized damage to the fabric. The operations may be controlled by air or electrically to provide desired sequence and timing. In FIG. 1, the various controls are shown mounted on a panel P that is carried on the base housing 11.

As shown particularly in FIGS. 1, 1A, 2, 3 and 10, each creasing blade 47, 47' of the side pairs represented by an upper blade 47' and a lower blade 47, is provided substantially fully along its length with a pair of electric heating elements 43 of strip-like form. Each element 43 may be secured flat on the side of an associated blade as by cementing. The elements 43 are secured along opposite sides of each blade. Each heating element strip 43 may be of a type similar to the type used for thawing roof gutters during the winter time. If a conventional creasing blade 47, 47' of, for example, one-eighth of an inch in thickness and one-half of an inch in vertical heighth or dimension is employed, it will be apparent that the strips 43 may also be of one-half of an inch in width or vertical extent (see FIG. 3).

Figure 10:
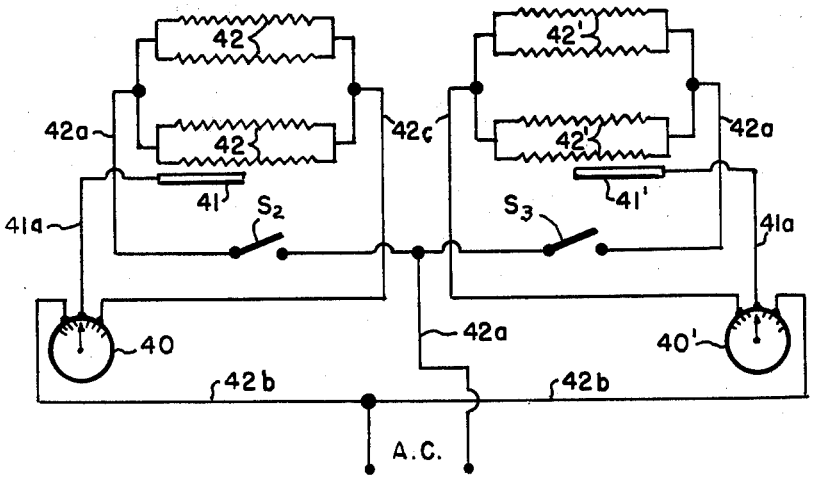
FIG. 10 is a diagrammatic showing of an electrical control circuit for heating the creasing blades of FIGS. 1, 1A, 2 and 3.

FIG. 1A somewhat diagrammatically shows the arrangement of steam piping system A, as well as the arrangement of the creasing blade side pairs 47, 47'. Since the garment bag B tends to shield the lower blades 47 from cooling while the upper blades 47' are more exposed, separate controls are provided (as shown in FIG. 10) for heating elements 42, 42' of the upper and lower strips 43' and 43. Like the elements of the heater 36, temperature-sensitive probe means 41, 41' is provided and used with automatic control means, as represented by units 40 and 40'. In this manner, the desired temperature of the upper and lower element-containing strips 43', 43 is separately maintained for the upper and lower members of the creasing blades 47', 47. That is, each control unit 40, 40' may have it dial or hand set at a temperature to maintain the elements 42' of the upper blades 47' and the elements 42 of the lower blades 47 at individually required temperatures.

As shown in FIG. 10, the resistance elements on opposite sides of each creasing blade are connected in parallel with respect to each other and also in parallel with the elements of the other associated blade of the upper or lower level involved. Also, one lower blade 47 is provided with a temperature probe 41, and one upper blade 47' is provided with a temperature probe 41' which are connected through electric leads **41*a* to their respective control units 40 and 40'. As shown in FIG. 10, a 220 volt alternating current source of electricity is directly connected through lines 42*b* to the control units 40 and 40', and by line 42*a* and separate switches $S_2$ and $S_3$ to their respective heating elements 42 and 42'. The other side of each of the control units 40 and 40' is connected through leads 42*c* to the opposite potential side of the heating elements. Thus, since the probes 41 and 41' are sensitive to the respective temperatures of the upper and lower blades 47', 47, they will through the agency of the control units 40 and 40', cause an automatic variation of energy supplied in accordance with the requirements necessary to maintain the temperature at which the units have been set. That is, the probes 41 and 41' control the resistance to current flow that is offered by the units 40 and 40'** to increase the current supplied when the temperature needs to be raised and for decreasing the current supplied when the temperature needs to be lowered.

The units 40 and 40' may be of any conventional commercial construction available on the market and may be set for operating within a temperature range of about 250° to 450° F. The strips 43 will provide each creasing blade with a localized, accurately controlled temperature such as to improve the forming of creases in the garment being processed or pressed. Such a localized application has been found to be highly efficacious in providing a garment with creases that are accurate, uninterrupted along their lengths, sharp and lasting.

I claim:

1. In a garment finishing machine having a support base, a set of longitudinally extending creasing blades operatively carried by said support base, means carried by said support base for supplying heated fluid along said blades, said means for supplying heated fluid comprising an air supply duct, an electric heater of plate-like construction positioned to extend across said duct and define a plurality of air flow passageways therethrough for heating the air, and thermal probe means for controlling a supply of electric energy to said heater to maintain the air being supplied by said duct at a desired heated temperature.

2. In a garment finishing machine as defined in claim 1, electric heating means positioned on and extending along each of said blades, and thermal control means for separately sensing and controlling the temperature of at least a pair of said creasing blades.

3. In a garment finishing machine having a support base, a set of longitudinally extending creasing blades operatively carried by said support base, means for mounting a permeable garment bag along said blades, an air-supply duct connected to said bag, a blower for supplying air to and moving it through said duct to expand said bag, a motor for driving said blower, and means for quickly braking said motor on de-energization thereof to stop said blower and deflate the garment bag.

4. In a garment finishing machine as defined in claim 3, said motor having a drive shaft, said braking means comprising a brake drum on said drive shaft and brake shoes that are mechanically urged into braking engagement with said drum, and electrical solenoid means connected for energization with said motor and adapted to hold said shoes out of engagement with said drum when said motor is being energized.

5. In a garment finishing machine having a support base, a set of creasing blades extending longitudinally forwardly from said support base, heat-supplying means secured to and extending along said blades, said set of blades comprising transversely spaced-apart side pairs of upper and lower creasing blades along opposite sides of the machine, and means for separately sensing and controlling the temperature of the upper and lower blades of said side pairs.

6. In a finishing machine as defined in claim 5, said heat-supplying means comprising electrical heating element strips secured along opposite sides of each of said creasing blades.

7. In a garment finishing machine having a support base, a set of creasing blades extending longitudinally forwardly from the support base, heat-applying electrical heating element strips secured to and extending along said blades, said blades comprising spaced-apart side pairs of upper and lower blades, the strips of the lower blades of each side pair being electrically connected in parallel for connection to a common source of electrical energy, and the strips of the upper blades of each said side pair being also electrically connected in parallel for connection to a common source of electrical energy.

8. In a garment finishing machine as defined in claim 7, said heat-applying heating element strips being carried along opposite sides of each of said blades.

9. In a garment finishing machine having a support base, a fluid-supplying head and a longitudinally forwardly extending support frame carried by the head, a permeable garment bag carried by said head and extending along said support frame, upper and lower creasing blades operatively carried along said support frame and having a transversely expanding and contracting movement with respect to each other, an air supplying blower carried by the support base, a motor operatively connected to said blower for actuating it, an electric circuit for energizing said motor, brake means for said motor connected for electrical energization during electrical energization of said motor and operative to substantially instantaneously stop said motor when electrical energy to said motor is switched-off, an air duct leading from said blower upwardly to said head for supplying air to said bag, heating means operatively positioned in said duct for heating the air as it moves therealong, means for automatically controlling the heat supplied by said unit in accordance with a desired temperature to be attained by the air during its upward movement, a steam supply and heating pipe system extending along said support frame for supplying heat to the inside of said garment bag and for periodically supplying steam bursts therein, heating means carried by each of said creasing blades, and means for automatically controlling the temperature of said last-mentioned heating means in accordance with a desired temperature to be imparted to said blades.

10. In a garment finishing machine having a support base, a set of creasing blades extending longitudinally forwardly from said support base, heat-supplying means secured to and extending along said blades, longitudinally extending supporting means carried on said support base, a steam supply header carried on said support base, a hot air supply duct, a permeable garment bag positioned along said supporting means and connected at an open end thereof to receive hot air from said supply duct, a closed loop piping system extending along said supporting means and connected at an inlet end to said steam supply header for indirectly heating air within the bag, perforated diffusion members extending along said loop system for supplying bursts of steam within said bag, electrical heating means extending along said blades for individually heating them, and means carried by at least a pair of said blades for individually sensing and controlling their respective temperatures.

* * * * *